United States Patent [19]

Fukunaga

[11] 4,100,925

[45] Jul. 18, 1978

[54] COIN JAMMING DETECTING DEVICE

[75] Inventor: Motoaki Fukunaga, Himeji, Japan

[73] Assignee: Glory Kogyo Kabushiki Kaisha, Himeji, Japan

[21] Appl. No.: 751,708

[22] Filed: Dec. 17, 1976

[30] Foreign Application Priority Data

Dec. 26, 1975 [JP] Japan ..... 50/156914

[51] Int. Cl.[2] ..... G07D 3/00

[52] U.S. Cl. ..... 133/3 F

[58] Field of Search ..... 221/2, 3, 21, 15; 133/8, 3 R, 3 F, 3 A, 3 B, 3 C, 3 D, 3 E, 3 G, 3 H; 222/70

[56] References Cited

U.S. PATENT DOCUMENTS 3,332,430 7/1967 Busch ..... 133/3 R 3,795,343 3/1974 Shigemori et al. ..... 221/21 X 3,813,527 5/1974 Langston ..... 222/70 X

*Primary Examiner*—Stanley H. Tollberg

*Attorney, Agent, or Firm*—Wenderoth, Lind & Ponack

[57] ABSTRACT

The present invention is a coin jamming detecting device including a pulse generator for generating pulses at time intervals corresponding to the operation cycle of a coin moving section which operates to move coins delivered thereto from a coin supplying section into a coin storing section, a timer circuit for producing an abnormal signal when the time interval becomes longer than a predetermined period, and a drive control circuit which upon reception of the abnormal signal, operates to stop the coin supplying section, and the coin moving section.

2 Claims, 4 Drawing Figures

POWER SOURCE
T
Vcc
R6
R4
R2
R1
C7
R5
Th
C3
Tr
44
P
PULSE GENERATING SECTION
INITIAL RESET SWITCH
IR
CC
FF2
54
55
58
M2
M1
M3
FF3
56
57
RESET
SET
Vcc
SWE
51
52
53
50
DELAY CIRCUIT
49
48
47
46
45
FF1
42
41
43
STOP
SWC
START
SWD

COIN JAMMING DETECTING DEVICE

BACKGROUND OF THE INVENTION

This invention relates to coin jamming detecting devices in apparatuses such as coin sorting machines with a coin moving section adapted to move coins into a coin storing section.

In general, a coin sorting machine comprises: a coin supplying section for receiving and supplying coins different in outside diameter and denomination; a coin sorting section for sorting the coins supplied by the coin supplying section; and a coin moving section for moving the sorted coins into a coin storing section. Since the sorting of coins is carried out at high speed by the machine, the jamming of coins is liable to occur in the coin path to the coin moving section. Once a coin jam has occurred, the coins are accumulated and damaged since the coins continue to be delivered by the coin supplying section. If a number of coins are jammed, it is rather difficult to remove the jammed coins from the machine. Accordingly, in this case it is necessary to stop the machine as soon as possible.

SUMMARY OF THE INVENTION

Accordingly, an object of this invention is to provide a coin jamming detecting device for an apparatus having a coin moving section adapted to move coins into a coin storing section, in which the jamming of coins therein is detected so that the operation of the apparatus is automatically stopped.

The manner in which the foregoing object and other objects are achieved by this invention will become more apparent from the following detailed description and the appended claims when read in conjunction with the accompanying drawings, in which like parts are designated by like reference characters.

BRIEF DESCRIPTION OF THE INVENTION

DETAILED DESCRIPTION OF THE INVENTION

The invention will be described in detail with reference to the accompanying drawings.

Figure 1:
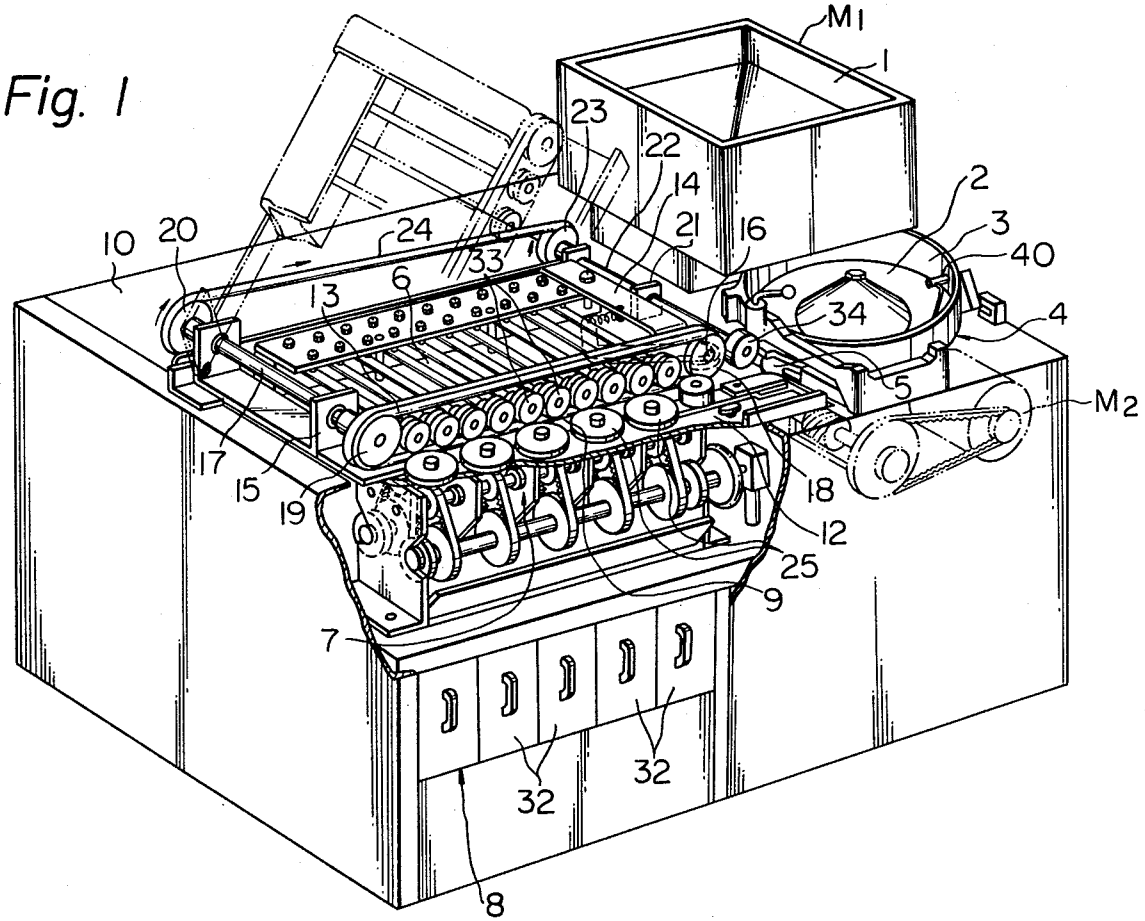
FIG. 1 is a perspective view illustrating a coin sorting machine to which this invention is applied.

FIG. 1 shows one example of a coin sorting machine to which the invention is applied. The coin sorting machine comprises: a hopper 1 adapted to feed a number of coins of different denominations; a coin supplying section 4 in which coins are received on a rotary disk 2 from the hopper 1 and the coins thus received are arranged along the peripheral wall 3 of the rotary disk 2 by centrifugal force caused by rotation of the rotary disk 2; a coin sorting section 6 connected to the outlet 5 of the coin supplying section 4; and a coin storing section 8 for storing sorted coins separately according to the denominations. The coin sorting section 6 is provided on a base plate 12 and has a coin sorting path 9 provided in line with the outlet 5 of the coin supply section.

Coin propelling endless belts 13 are provided above the coin sorting path 9. More specifically, the endless belts 13 are laid over pulleys 18 and 19 secured to pulley shafts 16 and 17 which are supported on the base plate 12 at the front and the rear ends of the path 9, respectively. A pulley 20 is provided at the other end of the pulley shaft 17, and a pulley 23 is secured to a shaft 22 which is supported through bearings 21 on another base plate 10. An endless belt 24 is laid over the pulleys 20 and 23. The pulley 20 is driven in the direction of the arrow by a coin sorting motor $M_2$ through a drive force transmission system (not shown) and the belt 24.

Figure 3:
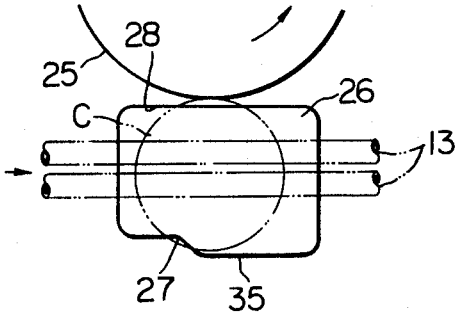
FIG. 3 is also an explanatory diagram for description of the functions of a coin sorting section, a coin moving section and a coin storing section shown in FIG. 1.
Figure 2:
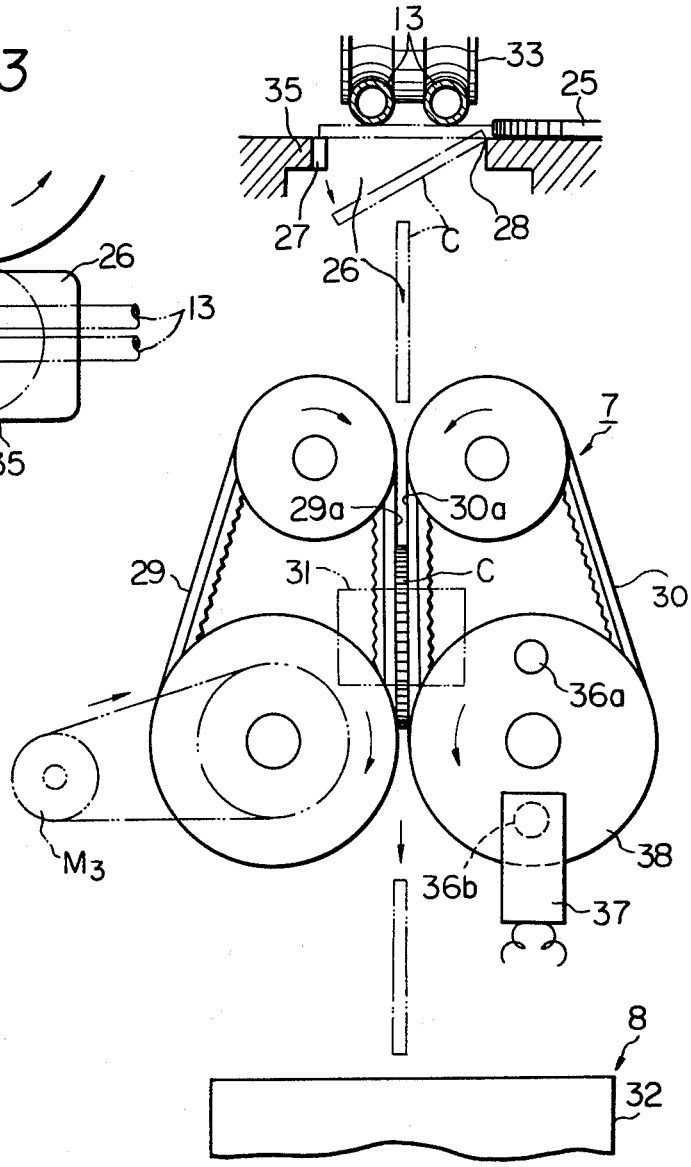
FIG. 2 is an explanatory diagram for description of the functions of the coin sorting machine.

As is shown in FIG. 2, the coin propelling endless belts 13 are further laid in parallel over a number of pulleys 33, and coin sorting openings 26 are provided in the coin path 9. Each opening 26, as shown in FIG. 3 also, is approximately rectangular, and has a projection 27 on the side remote from a path regulating member 25 arranged along the endless belts 13, so that a coin C conveyed to the opening 26 is initially supported by the projection 27 and a coin supporting part 28 defined by the path regulating member 25 and the side of the opening adjacent to the later, but when the coin is further moved, it comes off the projection 27, and drops through the opening 26. The coin sorting openings 26 are arranged in the order of the diameters of coins to be sorted, starting from the smallest one. For instance in the case where Japanese 1-yen, 5-yen, 10-yen, 50-yen and 100-yen coins are sorted, the opening for 1-yen coins is located nearest the outlet 5 of the coin supplying section, and the openings for 50-yen, 5-yen, 100-yen and 10-yen coins are provided in the stated order in succession with the opening for 1-yen coins.

Below each coin sorting opening is provided a coin moving means adapted to move the sorted coins into a coin storing section 8 (described later). The coin moving means 7 comprises a pair of coin moving belts 29 and 30 which sandwich the sorted coin to move it into the coin storing section 8. A coin counting mechanism 31 is provided beside the two belts 29 and 30, that is, beside a point where a sorted coin is sandwiched by the belts 29 and 30. This coin counting mechanism 31 operates to count coins by sensing the end of each coin sandwiched and moved downward by the two surfaces **29*a* and 30*a* of the belts 29 and 30. A microswitch or the combination of a photoelectric element and a light source can be employed as the sensing means of the coin counting mechanism. The belt 29 is run by a drive motor $M_3$ provided to transmit its torque to the pulley shaft of the belt 29. The other belt 30 is run in combination with the belt 29, when a coin is sandwiched between the belts 29 and 30**.

In the coin moving means 7, the belt 30, as shown in FIG. 2, is laid over a pulley 38 on which two iron pieces **36*a* and 36*b* are provided symmetric with respect to the center of the pulley 38. Beside the pulley 38 is provided a proximity switch 37 to detect the iron pieces 36*a* and 36*b*. Whenever the proximity switch 37 detects the iron piece, a pulse generating section P (FIG. 4**) produces a low level signal (hereinafter referred to as an "L" level signal or merely as an "L" signal).

A pulley 38 is provided for each coin taking means. However, all of the pulleys 38 are connected to one pulley shaft, and therefore the iron pieces **36*a* and 36*b* and the proximity switch 37 for detecting the iron pieces can be provided for only one of the pulleys 38**.

The aforementioned coin storing section 8 is provided below the coin moving means 7 so as to receive sorted coins. More specifically, the coin storing section comprises a plurality of coin storing boxes 32 (FIG. 1) which are provided just below the coin moving means 7, respectively, so as to receive and store sorted coins through the respective pairs of belts 29 and 30.

Delivery of coins from the hopper 1 to the rotary disk 2 is carried out by a coin supplying motor $M_1$ (not shown) and a conveyer (not shown). The rotary disk 2 and the coin propelling endless belts 13 are driven by the coin sorting motor $M_2$.

Figure 4:
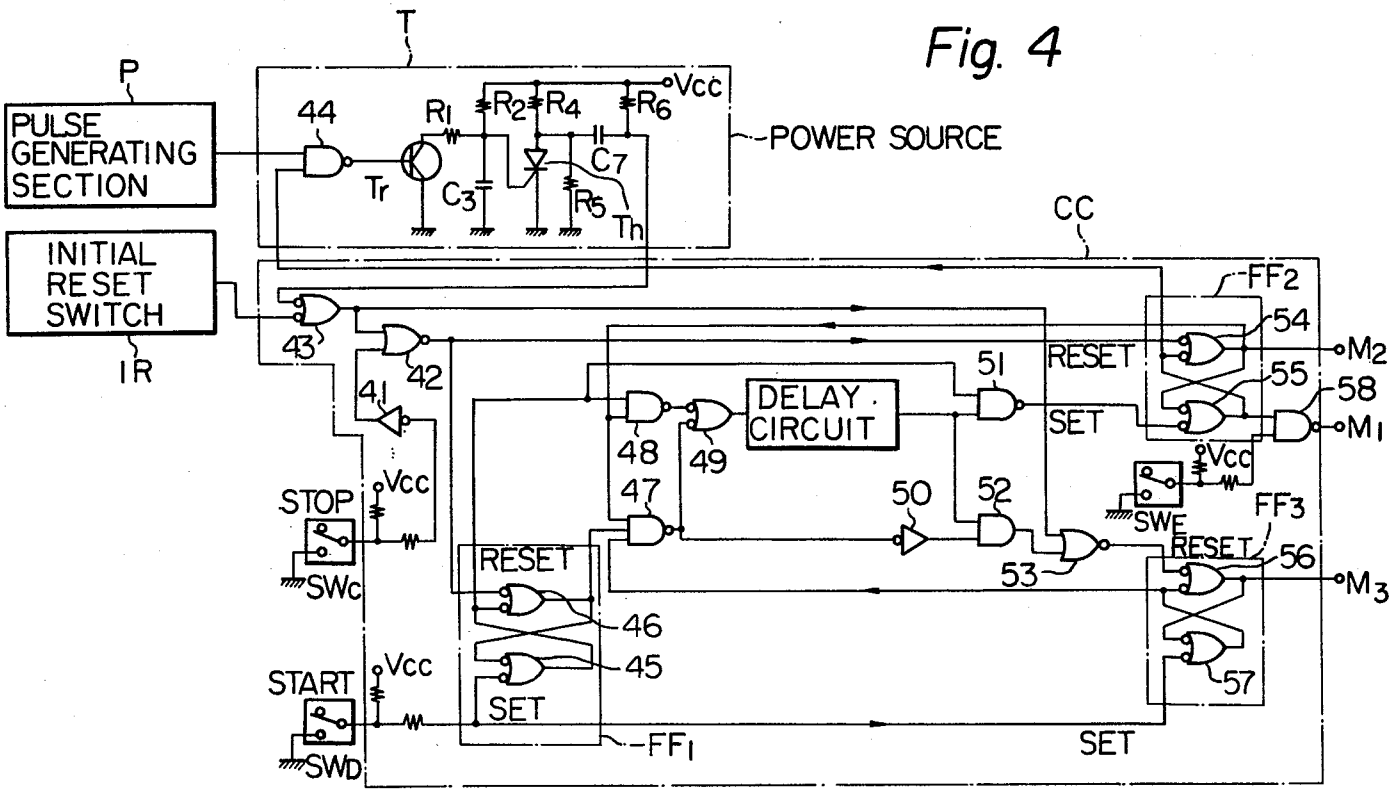
FIG. 4 is a circuit diagram (partly a block diagram) illustrating one example of a coin jamming detecting device according to this invention.

Shown in FIG. 4 is a circuit diagram illustrating one example of the coin jamming detecting device according to this invention. The circuit is divided roughly into three sections, namely, the aforementioned pulse generating section P, a timer section T, and a motor control section CC.

The pulse generating section P produces an "L" signal when the proximity switch 37 detects the iron piece 36*a* or 36*b* provided on the pulley 38, and produces a high level signal (hereinafter referred to as an "H" level signal or merely as an "H" signal when applicable) when it detects no iron piece (that is, for the period of time from the instant when the proximity switch 37 detects the iron piece 36*a* to the instant when the switch 37 detects iron piece 36*b* and for the period from the instant when the switch detects the iron piece 36*b* to the instant when the switch detects the iron piece 36*a*).

The timer section T comprises a NAND circuit 44, a transistor $T_r$, resistors $R_1$ through $R_5$, capacitors $C_3$ and $C_7$, and a thyristor $T_h$. When the period of time during which the pulse generating section P produces a "H" signal is longer than a predetermined period of time, it produces an "H" signal, namely, a motor stop signal. When the motors $M_1$ and $M_2$ are being driven, a motor drive indicating "H" signal is applied to the NAND circuit 44 from the motor control section CC. Therefore, when the output signal level of the pulse generating section P is changed from the "L" level to the "H" level, an "L" level signal is produced by the NAND circuit 44. Therefore, the transistor $T_r$ is rendered non-conductive, thus initiating the charging of the capacitor $C_3$ through the resistor $R_2$ from the power source Vcc. The period of time required for fully charging the capacitor $C_3$ is set slightly longer than the period of time during which the pulse generating section P produces the "H" level signal during normal operation. Therefore, if the coin sorting machine is operating normally, the "L" level signal is produced by the pulse generating section P before the capacitor $C_3$ is charged 100%. As a result, an "H" level signal is produced by the NAND circuit 44, the transistor $T_r$ is rendered conductive and the capacitor $C_3$ is discharged through the resistor $R_1$. Therefore, as long as the coin sorting machine is operating normally, no control current is applied to the thyristor $T_h$, that is, the thyristor $T_h$ is not turned on, and an operation permitting "H" signal is continuously applied to the motor control section CC.

When the coin jam is caused in the coin moving section 7 and the rotation of the pulley 38 is therefore slowed down or is stopped, it takes a longer time for the iron piece 36*a* or 36*b* to reach the proximity switch 37 or no iron piece reaches the proximity switch 37. Therefore, the "H" level output signal is produced by the pulse generating section P for a longer period of time than the predetermined period of time, and therefore the capacitor $C_3$ is charged. Accordingly, a control current is fully fed to the thyristor $T_h$ to render the latter conductive, that is, current momentarily flows in the thyristor $T_h$ through a differential circuit made up of the resistor $R_6$ and the capacitor $C_7$. As a result, an "L" level signal, namely, an abnormal signal is applied to the motor control circuit CC.

The motor control circuit CC comprises: an operating condition memory circuit $FF_1$ made up of two NAND circuits 45 and 46 for storing the states of an operation starting switch $SW_D$ and an operation stopping switch $SW_C$; a NAND circuit 43 to which the output signal of the timer section T and the output signal of an initial reset switch IR are applied; an inverter 41 for inverting the signal from the operation stopping switch $SW_C$; a NOR circuit 42 receiving the output of the NAND circuit 43 and the output of the inverter 41; a coin supplying/sorting motor drive memory circuit $FF_2$ constituted by two NAND circuits 54 and 55 for producing operation and stop commands to the coin supplying motor $M_1$ and the coin sorting motor $M_2$ and storing these commands; a coin moving motor drive memory circuit $FF_3$ constituted by two NAND circuits 56 and 57 for producing operation and stop commands to the coin moving motor $M_3$ and storing the commands; a NAND circuit 47 receiving the outputs of the NAND circuits 46, 54 and 57; a NAND circuit 48 to which the outputs of the NAND circuits 45 and 54 are applied; a NAND circuit 49 receiving the outputs of the NAND circuits 47 and 48; a delay circuit DT for delaying the output of the NAND circuit 49 for a predetermined period of time thereby to allow the coin moving motor $M_3$ to start after the coin supplying motor $M_1$ and the coin sorting motor $M_2$; a NAND circuit 51 connected to the "set" side of the memory circuit $FF_2$ (or one input of the NAND circuit 55) and receiving the outputs of the delay circuit DT and the NAND circuit 45; an inverter 50 for inverting the output of the NAND circuit 47; an AND circuit 52 receiving the outputs of the inverter 50 and the delay circuit DT; and a NOR circuit 53 receiving the outputs of the AND circuit 52 and the NOR circuit 43 and connected to the "reset" side of the memory circuit $FF_3$ (or one input of the NAND circuit 56), whereby the motors $M_1$, $M_2$ and $M_3$ are operated (driven or stopped) according to the operation permitting "H" signal and the abnormal "L" signal produced by the timer section T.

A switch $SW_E$ connected to the NAND circuit 58 is operated in association with a lever 40 shown in FIG. 1. More specifically, when the quantity of the coins on the rotary disk 2 reaches a predetermined value, the switch $SW_E$ is turned on, as a result of which the output level of the NAND circuit 58 becomes an "H" level thereby to stop the coin supplying motor $M_1$.

The operation of the circuit shown in FIG. 4 in the case where the coin sorting machine is operated normally will be described by referring also to FIGS. 1, 2 and 3.

Before operation, a reset "L" signal is produced by the initial reset switch IR to reset the entire coin sorting machine. As a result, the NAND circuit 43 produces an "H" signal, the NOR circuit 42 produces an "L" signal, and the NAND circuit 54 outputs an "H" signal, whereby the coin sorting motor $M_2$ is stopped. On the other hand, the NAND circuit 55 outputs an "L" signal, and the NAND circuit 58 outputs an "H" signal, as a result of which the coin supplying motor $M_1$ is stopped. Furthermore, the NOR circuit 53 produces an "L"

signal, and the NAND circuit 56 outputs an "H" signal, whereby the coin taking motor $M_3$ is stopped.

The operation starting switch $SW_D$ is turned on to start the operation of the machine. Then, the NAND circuit 45 outputs an "H" signal, the timer section T produces an "H" signal, the inverter 41 outputs an "L" signal as the operation stopping switch $SW_C$ is off, the NAND circuit 46 produces an "L" signal, the NAND circuit 47 outputs an "H" signal, the NAND circuit 48 produces an "L" signal, the NAND circuit 49 produces an "H" signal, the inverter 50 outputs an "L" signal, the NAND circuit 51 outputs an "L" signal, the NAND circuit 55 outputs an "H" signal, and the NAND circuit 58 outputs an "L" signal. As a result, the coin supplying motor $M_1$ is operated. At the same time, the NAND circuit 54 produces an "L" signal, whereby the coin sorting mortor $M_2$ is started. An "H" signal is produced by the timer section T a predetermined period of time after the start of the coin sorting motor $M_2$ has been started (more specifically, after the NAND circuit 49 has produced the "H" signal), the AND circuit 52 produces an "L" signal, the NOR circuit 53 outputs an "H" signal, and the NAND circuit 56 outputs an "L" signal, as a result of which the operation of the coin taking motor $M_3$ is started.

Under this condition, if a number of various coins are loaded in the hopper 1 (FIG. 1), these coins are conveyed by a conveyer (not shown) driven by the coin supplying motor $M_1$ to the rotary disk 2. The coins thus conveyed are arranged along the circumferential wall 3 by the centrifugal force of the rotary disk 2 and are delivred to the coin path 9 through the outlet 5. The coins C are further delivered by a feeding roller 34 to the coin propelling endless belts 13 at certain intervals. In this operation, the belts 13 are vertically deflected by the entering of the coins, and the coins are kept pressed by the restoring force of the belts thus deflected. Thus, the coins can be conveyed without slipping out of the belts 13.

The case where a delivered coin is a 1-yen coin will be described. When it is delivered to the top coin sorting opening 26 located nearest to the outlet 5, one end of the coin, striking against the path regulating member 25, is directed toward the opposite side of the path regulating member. However, since the coin propelling endless belts 13 are supported by the pulleys 33 as is shown in FIG. 2, the coin C is forced to abut against the path regulating member 25. Therefore, the coin is advanced with one end on the coin supporting part 28 of the opening. The coin, being held horizontally by the belts 13, is moved further until it comes off the projection 27. At the moment when the coin comes off the projection, the portion of the coin supported by the projection 27 becomes free. As a result, the coin, supported by only the coin supporting part 28, is forcibly dropped into the opening 26 with the vertical deflection of the belts 13 released. In this case, as is clear from the above description, the coin is dropped with its end, which was supported by the projection, down; that is, it is dropped first in an inclined posture, and then in an approximately upright posture as shown in FIG. 2.

The coin dropped in an upright posture through the opening 26 enters, in that upright posture, between the coin moving belts 29 and 30 of the respective coin moving means 7, and is moved downward, being sandwiched by the belts 29 and 30. While it is moved downward, it is counted by the coin counting mechanism 31, and it is received by the respective coin storing box 32 in the coin storing section.

Even if the coins other than 1-yen coins reach the 1-yen coin opening 26, they bypass it; that is, they are moved on mounting over the 1-yen coin opening 26, but when they reach their respective openings 26, they are dropped into the openings in the same manner as the 1-yen coin.

If no coins are caught in the coin moving means 7, the pulley 38 will run at a contant speed. Therefore, the proximity switch 37 detects the iron pieces **36*a* and 36*b* at predetermined time intervals, and the pulse generating section P outputs an "L" signal at the predetermined time intervals. Therefore, the capacitor $C_3$ is discharged before it is fully charged as was described before, and the timer section T continues to output the operation permitting "H" signal. Accordingly, the output of the NOR circuit 43** is still kept at the "L" level and the output levels of the memory circuits FF and FF are not changed. Therefore, the operations of the motors $M_1$, $M_2$ and $M_3$ are continued, and the coin sorting operation is continued.

Thus, sorted coins are received by their respective coin storing boxes 32. When the quantity of the coins in a coin storing box reach a certain value, a detecting means is operated to switch the operation stopping switch $SW_C$ on (while the operation starting switch $SW_D$ is turned off). As a result, the inverter 41 outputs an "H" signal, the NOR circuit 42 produces an "L" signal, and the NAND circuit 54 produces an "H" signal, whereby the operation of the coin sorting motor $M_2$ is stopped. On the other hand, the NAND circuit 51 produces an "H" signal, the NAND circuit 55 provides an "L" signal, and the NAND circuit 58 outputs an "H" signal, as a result of which the coin supplying motor $M_1$ is stopped. On the other hand, the NAND circuit 46 outputs an "H" signal, the HAND circuit 47 produces an "L" signal, the NAND circuit 48 produces an "H" signal, the NAND circuit 49 outputs an "H" signal, the inverter 50 provides an "H" signal, the NAND circuit 49 produces an "H" signal so that the delay section DT outputs an "H" signal after a predetermined period of time, the AND circuit 52 outputs an "H" signal, the NOR circuit 53 produces an "L" signal, and the NAND circuit 56 outputs an "H" signal, whereby the operation of the coin moving motor $M_3$ is suspensed.

If a coin or coins are caught in the coin moving means 7, the rotation of the pulley 38 is decreased or stopped, and therefore the detection of the iron piece **36*a* (or 36*b*) by the proximity switch 37 is delayed. As a result, the pulse generating section P continues to output the "H" signal over the predetermined period of time, and therefore a gate current is delivered to the thyristor $T_h$ by the capacitor $C_3$, and the abnormal "L" signal is produced by the timer section T. Accordingly, the NAND circuit 43 outputs an "H" signal, the NOR circuit 42 produces an "L" signal, and the NAND circuit 54 provides an "H" signal, as a result of which the coin sorting motor $M_2$ is stopped. On the other hand, the NAND circuit 55 outputs an "L" signal, and the NAND circuit 58 produces an "H" signal, whereby the coin supplying motor $M_1$ is stopped. On the other hand, the NAND circuit 47 outputs an "L" signal, the NAND circuit 49 produces an "H" signal, the inverter 50 outputs an "H" signal, the NAND circuit 49 outputs an "L" signal so that the delay circuit DT outputs an "H" signal after the predetermined period of time, the AND circuit 52 produces an "H" signal, the NOR circuit 53** provides an "L" signal, and the NAND citcuit 56 outputs an "H" signal, whereby the coin taking motor $M_3$ is stopped. Thus, whenever the coin jamming occurs in the coin taking means, the coin sorting machine is stopped.

The invention has been described with reference to the case where coins are sorted out according to the denominations and are stored in the respective coin storing boxes. However, the present invention can be applied to an apparatus which has no coin sorting section and operates merely to move the received coins into the coin storing section. The means for detecting the operation cycle of the coin moving means (or the revolution of the pulley 38) is not limited to the combination of the proximity switch and the iron pieces, and may be replaced, for instance, by the combination of a light emitting element and a light receiving element.

As is apparent from the above description, in this invention pulses are generated at time intervals corresponding to the operation cycle of the coin moving section, and if the time interial becomes longer than the predetermined period of time because of coins caught in the coin moving section, the operations of the coin receiving section and the coin moving section (and also the coin sorting section if the machine handles coins of different denominations) are automatically stopped. Therefore, with the machine according to this invention, no coins are accumulated and damaged, and no trouble are caused in the machine by the coins caught therein.

What is claimed is:

1. A coin jamming detecting device in an apparatus comprising a coin receiving means for receiving coins from outside and a coin moving means for moving coins delivered thereto by the coin receiving means into a coin storing section, which device comprises:

a pulse generating means associated with said coin moving means for generating pulses at time intervals proportional to the time interval of an operation cycle of said coin moving means;

a timer means operatively connected to said pulse generating means, for producing an abnormal signal when the time interval between said pulses generated by said pulse generating means becomes longer than a predetermined period of time; and a drive control means operatively connected to said timer means, for stopping the operations of said coin receiving means and said coin moving means upon reception of said abnormal signal.

2. A coin jamming detecting device in an apparatus comprising a coin receiving means for receiving a variety of coins different in diameter, a coin sorting means for sorting the coins delivered from the coin receiving means according to denominations, and a plurality of coin moving means provided respectively for the denominations, for moving coins sorted by said coin sorting means into coin storing containers provided separately according to the denomination, said plurality of coin moving means operating in synchronous relation with one another, which device comprises:

a pulse generating means associated with one of said coin moving means for generating pulses at time intervals proportional to the time interval of an operation cycle of said one of said coin moving means;

a timer means operatively connected to said pulse generating means, for producing an abnormal signal when the time interval between said pulses generated by said pulse generating means becomes longer than a predetermined period of time; and a drive control means operatively connected to said timer means, for stopping the operations of said coin receiving means, said coin sorting means, and said coin moving means upon reception of said abnormal signal.

* * * * *